US009323260B2

(12) United States Patent
Kim

(10) Patent No.: US 9,323,260 B2
(45) Date of Patent: Apr. 26, 2016

(54) INTERNAL VOLTAGE GENERATION CIRCUITS AND SEMICONDUCTOR DEVICES INCLUDING THE SAME

(71) Applicant: SK hynix Inc., Icheon-si Gyeonggi-do (KR)

(72) Inventor: Jae Hoon Kim, Icheon-si (KR)

(73) Assignee: SK hynix Inc., Icheon-si (KR)

( * ) Notice: Subject to any disclaimer, the term of this patent is extended or adjusted under 35 U.S.C. 154(b) by 300 days.

(21) Appl. No.: 14/175,315

(22) Filed: Feb. 7, 2014

(65) Prior Publication Data

US 2015/0070053 A1 Mar. 12, 2015

(30) Foreign Application Priority Data

Sep. 12, 2013 (KR) ..... 10-2013-0109846

(51) Int. Cl.
*G05F 1/10* (2006.01)
*G05F 3/02* (2006.01)
*G05F 1/46* (2006.01)

(52) U.S. Cl.
CPC ..... *G05F 1/465* (2013.01)

(58) Field of Classification Search
CPC ..... G05F 1/465; G05F 1/56; G11C 5/145; G11C 5/147; H02M 3/073; H02M 3/07
USPC ..... 327/540, 541, 534–538, 108–112, 427, 327/434, 437; 326/82, 83, 87
See application file for complete search history.

(56) References Cited

U.S. PATENT DOCUMENTS 7,791,959 B2 * 9/2010 Chun ..... G11C 7/04 327/534
2005/0264347 A1 * 12/2005 Gyohten ..... G05F 1/465 327/540
2010/0141332 A1 * 6/2010 Byeon ..... G11C 5/145 327/536

FOREIGN PATENT DOCUMENTS

KR 1020080070929 A 8/2008
KR 1020100050139 A 5/2010

* cited by examiner

*Primary Examiner* — Lincoln Donovan
*Assistant Examiner* — Thomas Skibinski
(74) *Attorney, Agent, or Firm* — William Park & Associates Ltd.

(57) ABSTRACT

An internal voltage generation circuit including a voltage generator and a detection voltage generator. The voltage generator generates a temperature reference voltage signal whose level depends on an internal temperature, a division reference voltage signal whose level is constant regardless of the internal temperature, and a selection reference voltage signal obtained by detecting a level of an internal voltage signal. The detection voltage generator compares the division reference voltage signal and the selection reference voltage signal in response to the temperature reference voltage signal to generate a detection voltage signal controlling a pumping operation of the internal voltage signal.

20 Claims, 5 Drawing Sheets

INTERNAL VOLTAGE GENERATION CIRCUITS AND SEMICONDUCTOR DEVICES INCLUDING THE SAME

CROSS-REFERENCE TO RELATED APPLICATION

The present application claims priority under 35 U.S.C 119(a) to Korean Application No. 10-2013-0109846, filed on Sep. 12, 2013, in the Korean Intellectual Property Office, which is incorporated herein by reference in its entirety as set forth in full.

BACKGROUND

1. Technical Field

Embodiments of the present disclosure generally relate to semiconductor integrated circuits and, more particularly, to internal voltage generation circuits and semiconductor devices including the same.

2. Related Art

In general, semiconductor devices receive a power supply voltage VDD and a ground voltage VSS from an external device to generate internal voltages used in operations of internal circuits constituting each of the semiconductor devices. The internal voltages for operating the internal circuits of the semiconductor devices may include a core voltage VCORE supplied to core regions including memory cells, a boost voltage VPP used to drive or overdrive word lines, and a back-bias voltage VBB applied to a bulk region (or a substrate) of NMOS transistors in the core region.

The core voltage VCORE may be a positive voltage which is lower than the power supply voltage VDD supplied from the external system. Thus, the core voltage VCORE may be generated by lowering the power supply voltage VDD to a certain level. In contrast, the boost voltage VPP may be higher than the power supply voltage VDD, and the back-bias voltage VBB may be a negative voltage which is lower than the ground voltage VSS. Thus, charge pump circuits may be required to generate the boost voltage VPP and the back-bias voltage VBB.

SUMMARY

Various embodiments are directed to internal voltage generation circuits and semiconductor devices including the same.

According to some embodiments, an internal voltage generation circuit includes a voltage generator and a detection voltage generator. The voltage generator generates a temperature reference voltage signal whose level depends on an internal temperature, a division reference voltage signal whose level is constant regardless of the internal temperature, and a selection reference voltage signal obtained by detecting a level of an internal voltage signal. A level of the selection reference voltage signal is controlled according to a first test mode signal. The detection voltage generator compares the division reference voltage signal and the selection reference voltage signal in response to the temperature reference voltage signal to generate a detection voltage signal controlling a pumping operation of the internal voltage signal.

According to further embodiments, an internal voltage generation circuit includes a comparison driver and a level controller. The comparison driver compares a selection reference voltage signal with a division reference voltage signal to control a drive of a detection voltage signal. A level of the selection reference voltage signal is controlled according to an internal voltage signal and a first test mode signal, and a level of the division reference voltage signal is constant regardless of an internal temperature. The detection voltage signal controls a pumping operation of the internal voltage signal. The level controller compares a temperature reference voltage signal with the division reference voltage signal in response to a second test mode signal to control a level of the selection reference voltage signal driving the detection voltage signal. A level of the temperature reference voltage signal depends on the internal temperature.

According to further embodiments, a semiconductor device includes a control circuit and an internal voltage generation circuit. The control circuit generates a first test mode signal, a second test mode signal, and a power supply voltage. The internal voltage generation circuit generates a reference voltage signal in response to the power supply voltage, generates a temperature reference voltage signal, a division reference voltage signal and a selection reference voltage signal which are obtained from the reference voltage signal. In addition, the internal voltage generation circuit compares the selection reference voltage signal with the division reference voltage signal in response to the temperature reference voltage signal to generate a detection voltage signal controlling a pumping operation of an internal voltage signal. A level of the temperature reference voltage signal depends on the internal temperature. A level of the division reference voltage signal is constant regardless of the internal temperature. A level of the selection reference voltage signal is controlled according to a level of the internal voltage signal and a level of the first test mode signal.

BRIEF DESCRIPTION OF THE DRAWINGS

Embodiments of the present invention will become more apparent in view of the attached drawings and accompanying detailed descriptions, in which.

DETAILED DESCRIPTION

Various embodiments of the present invention will be described hereinafter with reference to the accompanying drawings. However, the embodiments described herein are for illustrative purposes only and are not intended to limit the scope of the present invention.

Figure 1:
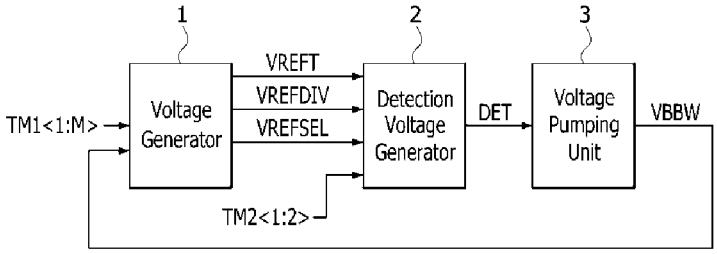
FIG. 1 is a block diagram illustrating an internal voltage generation circuit according to an embodiment of the present invention.

Referring to FIG. 1, an internal voltage generation circuit according to an embodiment of the present invention may include a voltage generator 1, a detection voltage generator 2 and a voltage pumping unit 3. The voltage generator 1 may generate a temperature reference voltage signal VREFT, a division reference voltage signal VREFDIV and a selection reference voltage signal VREFSEL. A level of the temperature reference voltage signal VREFT may depend on an internal temperature of the internal voltage generation circuit or voltage generator. A level of the division reference voltage signal VREFDIV may be constant regardless of the internal temperature of the internal voltage generation circuit and/or the voltage generator. The selection reference voltage signal VREFSEL may be generated in response to a level of an internal voltage signal VBBW, and a level of the selection reference voltage signal VREFSEL may be decreased by a first test mode signal TM1<1:M>. The detection voltage generator 2 may generate a detection voltage signal DET driven by the temperature reference voltage signal VREFT, the division reference voltage signal VREFDIV and the selection reference voltage signal VREFSEL in response to a second test mode signal TM2<1:2>. The detection voltage generator 2 may detect a level of the internal voltage signal VBBW according to the internal temperature of the internal voltage generation circuit, voltage generator 1, detection voltage generator 2, or voltage pumping unit 3 to generate the detection voltage signal DET controlling a drive of the internal voltage signal VBBW. The voltage pumping unit 3 may pump the internal voltage signal VBBW in response to the detection voltage signal DET. When the detection voltage signal DET is driven to a predetermined level, the voltage pumping unit 3 may be activated to pump the internal voltage signal VBBW such that the internal voltage signal VBBW has a negative voltage lower than a ground voltage VSS. In an embodiment, when the detection voltage signal DET is driven to have a logic "high" level, the voltage pumping unit 3 may pump the internal voltage signal VBBW to lower a level of the internal voltage signal VBBW.

Figure 2:
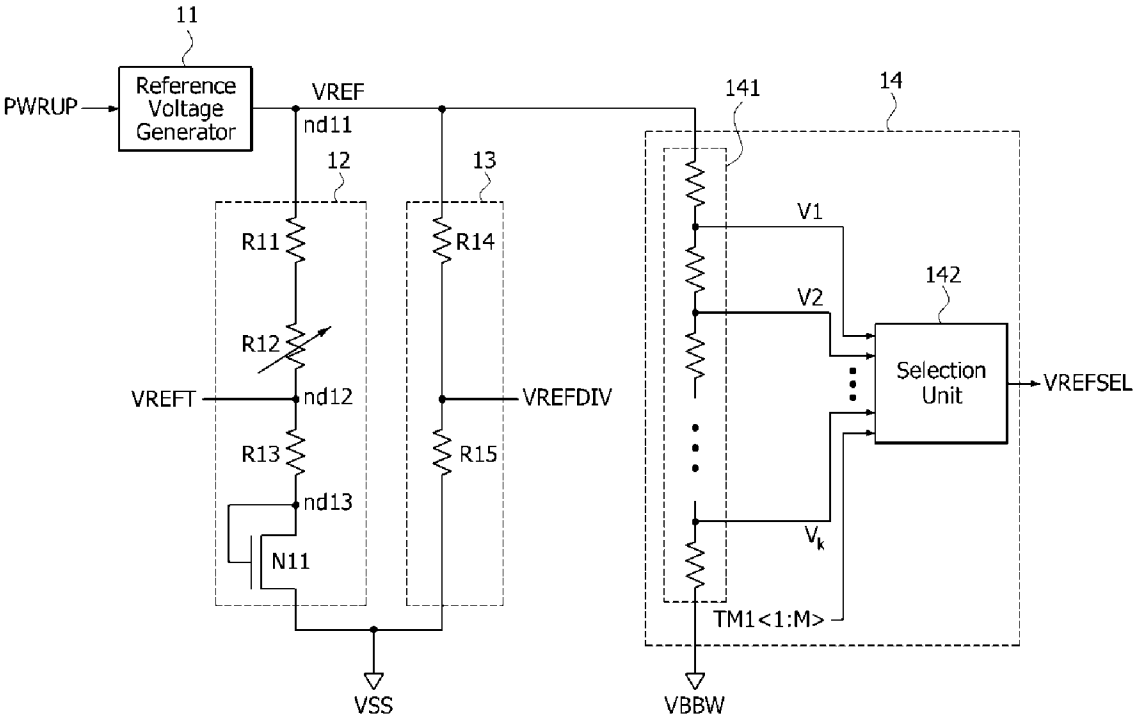
FIG. 2 is a schematic view illustrating a voltage generator included in the internal voltage generation circuit of FIG. 1.

Referring to FIG. 2, the voltage generator 1 may include a reference voltage generator 11, a temperature reference voltage generator 12, a division reference voltage generator 13 and a selection reference voltage generator 14.

The reference voltage generator 11 may generate a reference voltage signal VREF from a moment that a power-up period terminates in response to a power-up signal PWRUP. The reference voltage signal VREF may be outputted through a node ND11. The power-up period may correspond to a time period it takes a power supply voltage VDD to reach a predetermined level after the power supply voltage VDD is applied to the semiconductor device. A level of the power-up signal PWRUP may be changed at a moment that the power-up period terminates.

The temperature reference voltage generator 12 may include resistive elements R11, R12 and R13 and an NMOS transistor N11, and a level of the resistive elements R11 and R12 may vary according to the internal temperature of the voltage generator. The resistive elements R11 and R12 may be serially coupled between the node nd11 and a node nd12. Further, the resistive element R13 and the NMOS transistor N11 may be serially coupled between the node nd12 and a ground voltage VSS terminal. The resistive element R12 may be realized using a variable resistor. A drain and a gate of the NMOS transistor N11 may be electrically coupled to each other. A node nd13 may be coupled with one end of the resistive element R13 and the drain and gate of the NMOS transistor N11. Thus, the NMOS transistor N11 may act as a diode and may function as a temperature sensitive element whose resistance value is linearly reduced as the temperature rises. The temperature reference voltage generator 12 may divide a voltage level of the reference voltage signal VREF in a ratio of a total resistance value of the resistive elements R11 and R12 to a total resistance value of the resistive element R13 and the NMOS transistor N11, thereby generating the temperature reference voltage signal VREFT whose level is linearly reduced as the internal temperature of the temperature reference voltage generator 12 or voltage generator or internal voltage generation circuit rises.

The division reference voltage generator 13 may include resistive elements R14 and R15 serially coupled between the node nd11 and the ground voltage VSS terminal and may generate the division reference voltage signal VREFDIV whose level is constant regardless of the internal temperature of the division reference voltage generator 13, voltage generator 1, or internal voltage generation circuit. The division reference voltage generator 13 may divide a voltage level of the reference voltage signal VREF in a ratio of a resistance value of the resistive element R14 and a resistance value of the resistive element R15, thereby generating the division reference voltage signal VREFDIV whose level is constant regardless of the temperature of the division reference voltage generator 13, voltage generator 1, or internal voltage generation circuit.

The selection reference voltage generator 14 may include a voltage divider 141 and a selection unit 142. The voltage divider 141 may include a plurality of resistive elements serially coupled between the node nd11 and an internal voltage VBBW terminal and may generate a plurality of voltage signals V1, V2, . . . , and Vk. Levels of the plurality of voltage signals V1, V2, . . . , and Vk may be determined by dividing a voltage difference between the reference voltage signal VREF and the internal voltage signal VBBW in a ratio of resistance values of the plurality of resistive elements serially coupled between the node nd11 and an internal voltage VBBW terminal. The levels of the plurality of voltage signals V1, V2, . . . , and Vk may be lowered as the level of the internal voltage signal VBBW is lowered. This is because if the level of the internal voltage signal VBBW is lowered, a voltage difference between the reference voltage signal VREF and the internal voltage signal VBBW increases to increase a voltage drop of each of the resistive elements included in the voltage divider 141. The selection unit 142 may output one of the divided voltage signals V1, V2, . . . , Vk as the selection reference voltage signal VREFSEL in response to the first test mode signal TM1<1:M>. The selection reference voltage signal VREFSEL may be decreased and controlled to have any one of the levels of the divided voltage signals V1, V2, . . . , Vk according to a level combination of the first test mode signal TM1<1:M>. The number "M" of bits of the first test mode signal TM1<1:M> and the number "K" of the divided voltage signals V1, V2, . . . , Vk may be set to be different according to the embodiments. M and K may be positive integers.

Figure 3:
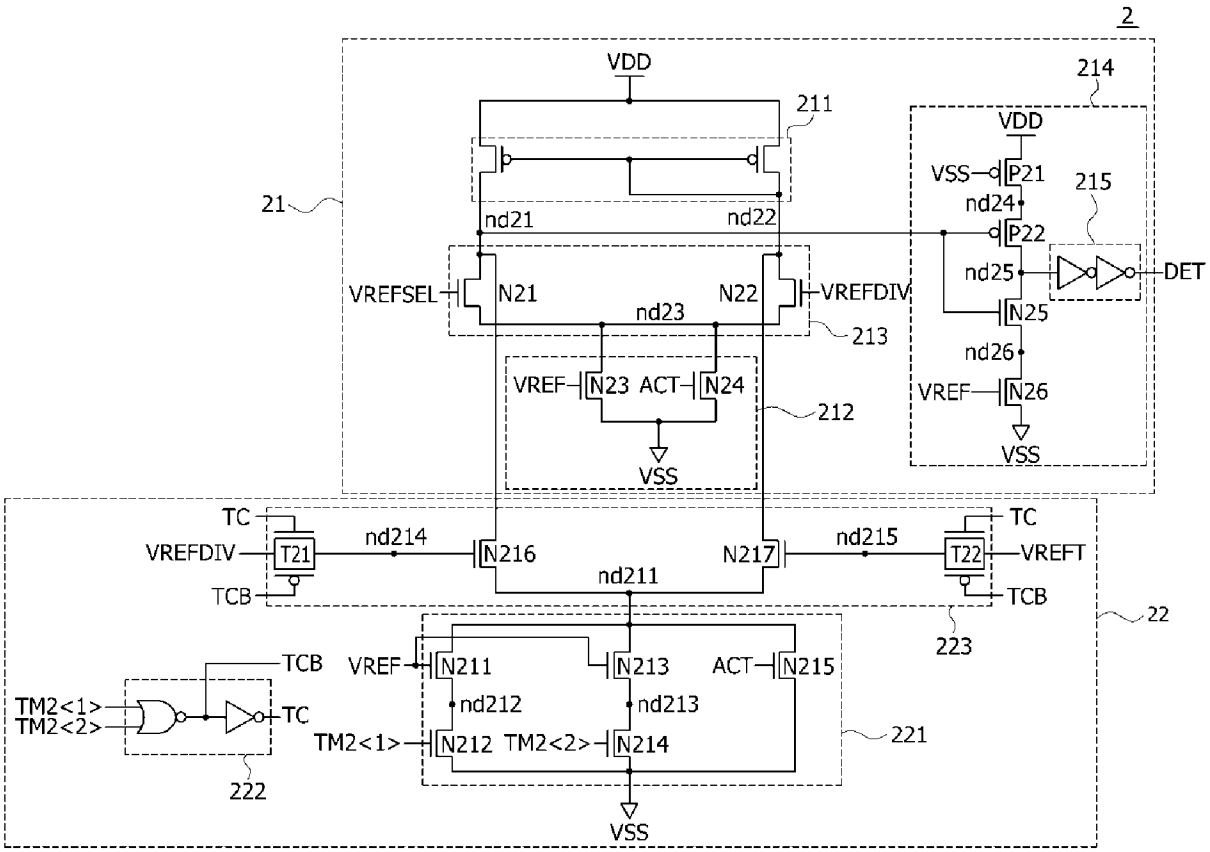
FIG. 3 is a circuit diagram illustrating a detection voltage generator included in the internal voltage generation circuit of FIG. 1.

Referring to FIG. 3, the detection voltage generator 2 may include a comparison driver 21 and a level controller 22.

The comparison driver 21 may include a constant current source 211, an activation unit 212, a comparison set unit 213 and a driver 214. The constant current source 211 may be realized using a current mirror circuit driven by the power supply voltage VDD to supply a constant current to nodes nd21 and nd22. The activation unit 212 may include NMOS transistors N23 and N24 coupled in parallel between a node nd23 and the ground voltage VSS terminal. The NMOS transistor N23 may be turned on in response to the reference voltage signal VREF, and the NMOS transistor N24 may be turned on in response to an active signal ACT. The reference voltage signal VREF may have a logic "high" level from a moment that the power-up period terminates, and the active signal ACT may have a logic "high" level when an external command signal (not shown) is inputted to execute an active operation. The comparison set unit 213 may include an NMOS transistor N21 turned on in response to the selection reference voltage signal VREFSEL and an NMOS transistor N22 turned on in response to the division reference voltage signal VREFDIV. The NMOS transistor N21 may be coupled between the node nd21 and the node nd23, and the NMOS transistor N22 may be coupled between the node nd22 and the node nd23. The driver 214 may include PMOS transistors P21 and P22, NMOS transistors N25 and N26, and a buffer 215. The PMOS transistor P21 may be turned on in response to the ground voltage VSS to drive a node nd24 to have the power supply voltage VDD. The PMOS transistor P22 may be turned on to drive a node nd25 to have a level of the node nd24 when the node nd21 has a logic "low" level. The NMOS transistor N25 may be turned on to drive the node nd25 to have a level of a node nd26 when the node nd21 has a logic "high" level. The NMOS transistor N26 may be turned on in response to the reference voltage signal VREF to drive the node nd26 to have the ground voltage VSS. The buffer 215 may buffer a signal of the node nd25 to generate the detection voltage signal DET.

The level controller 22 may include a discharge controller 221, a transmission control signal generator 222 and a discharger 223. The discharge controller 221 may be suitable for including NMOS transistors N211, N212, N213, N214 and N215. The NMOS transistor N211 may be coupled between a node nd211 and a node nd212 and may be turned on in response to the reference voltage signal VREF. The NMOS transistor N212 may be coupled between the node ND212 and the ground voltage VSS terminal and may be turned on in response to a first bit TM2<1> of the second test mode signal. The NMOS transistor N213 may be coupled between the node nd211 and a node nd213 and may be turned on in response to the reference voltage signal VREF. The NMOS transistor N214 may be coupled between the node nd213 and the ground voltage VSS terminal and may be turned on in response to a second bit TM2<2> of the second test mode signal. The NMOS transistor N215 may be coupled between the node ND211 and the ground voltage VSS terminal and may be turned on in response to the active signal ACT. The transmission control signal generator 222 may generate a complementary transmission control signal TCB enabled to have a logic "low" level and a transmission control signal TC enabled to have a logic "high" level when at least one bit of the second test mode signal TM2<1:2> has a logic "high" level. The discharger 223 may be suitable for including transfer gates T21 and T22 and NMOS transistors N216 and N217. The transfer gate T21 may be turned on in response to the transmission control signal TC having a logic "high" level and the complementary transmission control signal TCB having a logic "low" level to output the division reference voltage signal VREFDIV through a node nd214. The NMOS transistor N216 may be coupled between the node nd21 and the node nd211 and may be turned on in response to the division reference voltage signal VREFDIV transmitted to the node nd214. The transfer gate T22 may be turned on in response to the transmission control signal TC having a logic "high" level and the complementary transmission control signal TCB having a logic "low" level to output the temperature reference voltage signal VREFT through a node nd215. The NMOS transistor N217 may be coupled between the node nd22 and the node nd211 and may be turned on in response to the temperature reference voltage signal VREFT transmitted to the node nd215.

An operation of the detection voltage generator 2 illustrated in FIG. 3 will be described hereinafter with reference to FIG. 4 in conjunction with an example in which the internal temperature of the detection voltage generator or internal voltage generation circuit is 90 degrees Celsius and an example in which the internal temperature is 40 degrees Celsius below zero. In a graph of FIG. 4, the abscissa represents an internal temperature of the detection voltage generator or internal voltage generation circuit (in Celsius ° C.) and the ordinate represents a voltage level V.

Figure 4:
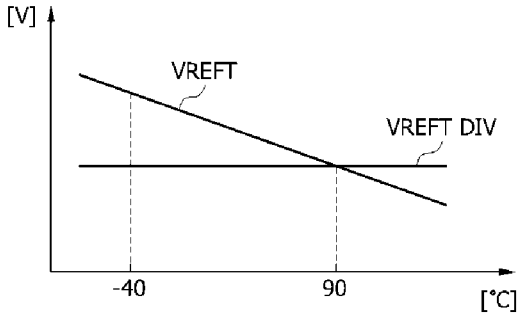
FIG. 4 is a graph illustrating an operation of the internal voltage generation circuit of FIG. 1.

Referring to FIG. 4, when the internal temperature of the internal voltage generation circuit reads 90 degrees Celsius, a level of the temperature reference voltage signal VREFT is equal to a level of the division reference voltage signal VREFDIV. Thus, the amount of charges discharged from the node nd21 through the NMOS transistor N216 may be equal to the amount of charges discharged from the node nd22 through the NMOS transistor N217. In such a case, if a level of the selection reference voltage signal VREFSEL is higher than a level of the division reference voltage signal VREFDIV, the NMOS transistor N21 may be turned on stronger than the NMOS transistor N22. Accordingly, since the node nd21 is set to have a logic "low" level, the detection voltage signal DET may be driven to have a logic "high" level through the driver 214. In contrast, if a level of the selection reference voltage signal VREFSEL is lower than a level of the division reference voltage signal VREFDIV, the NMOS transistor N22 may be turned on stronger than the NMOS transistor N21. Accordingly, since the node nd21 is set to have a logic "high" level, the detection voltage signal DET may be driven to have a logic "low" level through the driver 214.

When the internal temperature of the internal voltage generation circuit or detection voltage generator reads 40 degrees Celsius below zero, a level of the temperature reference voltage signal VREFT is higher than that of the division reference voltage signal VREFDIV. Thus, the amount of charges discharged from the node nd21 through the NMOS transistor N216 may be less than the amount of charges discharged from the node nd22 through the NMOS transistor N217. In such a case, the node nd21 has to be set to a logic "low" level in order that the detection voltage signal DET is driven to have a logic "high" level, and a level of the selection reference voltage signal VREFSEL at the internal temperature of 40 degrees Celsius below zero has to be higher than a level of the selection reference voltage signal VREFSEL at the internal temperature of 90 degrees Celsius in order that the node nd21 be set to have a logic "low" level. This is because a level of the temperature reference voltage signal VREFT becomes higher than a level of the division reference voltage signal VREFDIV as the internal temperature of the internal voltage generation circuit or detection voltage generator drops and a drain voltage (i.e., a level of the node nd21) of the NMOS transistor N21 becomes higher than a drain voltage (i.e., a level of the node nd22) of the NMOS transistor N22. Thus, a level of the selection reference voltage signal VREFSEL corresponding to a gate voltage required to turn on the NMOS transistor N21 has to increase in order that the node ND21 has a logic "low" level.

As described above, as the internal temperature of the internal voltage generation circuit or detection voltage generator drops, a level of the selection reference voltage signal VREFSEL for driving the detection voltage signal DET to a logic "high" level may increase. A pumping operation for obtaining the internal voltage signal VBBW may be executed when the detection voltage signal DET is driven to have a logic "high" level, and the pumping operation for obtaining the internal voltage signal VBBW may be terminated when the detection voltage signal DET is driven to have a logic "low" level. Thus, the pumping operation for obtaining the internal voltage signal VBBW may be terminated at a high level of the selection reference voltage signal VREFSEL as the internal temperature of the internal voltage generation circuit or detection voltage generator drops. If a level of the selection reference voltage signal VREFSEL increases, a level of the internal voltage signal VBBW which is detected may also increase. Accordingly, as the internal temperature of the internal voltage generation circuit or detection voltage generator drops, the pumping operation for obtaining the internal voltage signal VBBW may be terminated at a high level of the selection reference voltage signal VREFSEL. The internal voltage generation circuit according to the present embodiments may generate the temperature reference voltage signal VREFT, the division reference voltage signal VREFDIV and the selection reference voltage signal VREFSEL to control the pumping operation for obtaining the internal voltage signal VBBW according to variation of the temperature, and only the selection reference voltage signal VREFSEL may be decreased and generated in response to the first test mode signal TM1<1:M>. Thus, a level of the internal voltage signal VBBW may be stably decreased even though the internal temperature of the internal voltage generation circuit or detection voltage generator varies.

Figure 5:
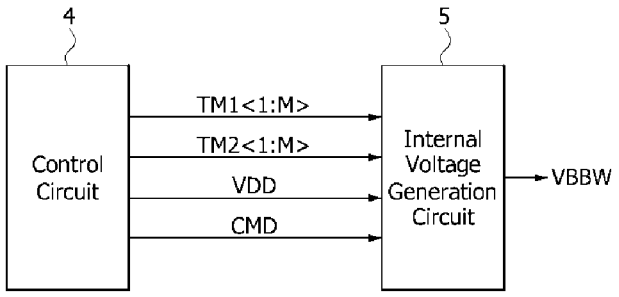
FIG. 5 is a block diagram illustrating a semiconductor device including an internal voltage generation circuit according to an embodiment of the present invention.

Referring to FIG. 5, a semiconductor device according to an embodiment may include a control circuit 4 and an internal voltage generation circuit 5. The control circuit 4 may generate a first test mode signal TM1<1:M>, a second test mode signal TM2<1:M>, a power supply voltage VDD and a command signal CMD and may apply the first test mode signal TM1<1:M>, the second test mode signal TM2<1:M>, the power supply voltage VDD and the command signal CMD to the internal voltage generation circuit 5. The internal voltage generation circuit 5 may control a pumping operation for obtaining an internal voltage signal VBBW in response to an active signal ACT (see FIG. 3) which is generated according to the command signal CMD after the power supply voltage VDD reaches a predetermined level from a moment that the power supply voltage VDD is applied to the semiconductor device. The internal voltage generation circuit 5 may have the same configuration as described with reference to FIGS. 1 to 4. Thus, a detailed description of the internal voltage generation circuit 5 will be omitted hereinafter.

According to the aforementioned embodiments, even though a temperature varies, a level of an internal voltage signal may be decreased to stably generate the internal voltage signal.

What is claimed is:

1. An internal voltage generation circuit, the circuit comprising:

a voltage generator suitable for generating a temperature reference voltage signal whose level depends on an internal temperature, a division reference voltage signal whose level is constant regardless of the internal temperature, and a selection reference voltage signal obtained by detecting a level of an internal voltage signal, a level of the selection reference voltage signal being controlled according to a first test mode signal; and a detection voltage generator suitable for comparing the division reference voltage signal and the selection reference voltage signal in response to the temperature reference voltage signal to generate a detection voltage signal controlling a pumping operation of the internal voltage signal.

2. The circuit of claim 1, wherein the voltage generator includes a temperature reference voltage generator; and wherein the temperature reference voltage generator is suitable for including a temperature sensitive element whose resistance value varies according to the internal temperature and suitable for dividing a level of a reference voltage signal to generate the temperature reference voltage signal.

3. The circuit of claim 2, wherein the voltage generator further includes a division reference voltage generator suitable for dividing the level of the reference voltage signal to generate the division reference voltage signal.

4. The circuit of claim 3, wherein the voltage generator further includes a selection reference voltage generator suitable for dividing the level of the reference voltage signal to generate a plurality of divided voltage signals and suitable for outputting one of the divided voltage signals as the selection reference voltage signal in response to the first test mode signal.

5. The circuit of claim 4, wherein the reference voltage signal is generated when a power supply voltage has a predetermined level or higher after the power supply voltage is applied to the voltage generator.

6. The circuit of claim 1, wherein a level of the temperature reference voltage signal increases as the internal temperature decreases.

7. The circuit of claim 6, wherein a level of the selection reference voltage signal for changing a level of the detection voltage signal is set to increase as the internal temperature decreases.

8. The circuit of claim 7, wherein the detection voltage generator is suitable for generating the detection voltage signal driven to a first level to execute the pumping operation of the internal voltage signal if a level of the selection reference voltage signal is higher than a level of the division reference voltage signal when the internal temperature has a predetermined temperature.

9. The circuit of claim 8, wherein the detection voltage generator is suitable for generating the detection voltage signal driven to a second level to terminate the pumping operation of the internal voltage signal if a level of the selection reference voltage signal is lower than a level of the division reference voltage signal when the internal temperature has the predetermined temperature.

10. The circuit of claim 1, wherein the detection voltage generator includes:

a comparison driver suitable for comparing the selection reference voltage signal with the division reference voltage signal to control a drive of the detection voltage signal; and a level controller suitable for comparing the temperature reference voltage signal with the division reference voltage signal in response to a second test mode signal to control a level of the selection reference voltage signal driving the detection voltage signal.

11. The circuit of claim 10, wherein the comparison driver includes:

a constant current source suitable for supplying a constant current to a first node and a second node;

a comparison set unit suitable for receiving the selection reference voltage signal and the division reference voltage signal to set a level of the first node and a level of the second node;

an activation unit suitable for activating the comparison set unit in response to a reference voltage signal and an active signal; and a driver suitable for driving the detection voltage signal in response to signals of the first and second nodes.

12. The circuit of claim 11, wherein the level controller includes:

a discharger suitable for discharging electric charges of the first and second nodes in response to the temperature reference voltage signal and the division reference voltage signal; and a discharge controller suitable for controlling the amount of electric charges discharged from the first and second nodes in response to the reference voltage signal, the active signal and the second test mode signal.

13. An internal voltage generation circuit, the circuit comprising:

a comparison driver suitable for comparing a selection reference voltage signal whose level is controlled according to an internal voltage signal and a first test mode signal with a division reference voltage signal whose level is constant regardless of an internal temperature to control a drive of a detection voltage signal controlling a pumping operation of the internal voltage signal; and a level controller suitable for comparing a temperature reference voltage signal whose level depends on the internal temperature with the division reference voltage signal in response to a second test mode signal to control a level of the selection reference voltage signal driving the detection voltage signal.

14. The circuit of claim 13, wherein a level of the temperature reference voltage signal increases as the internal temperature decreases.

15. The circuit of claim 14, wherein a level of the selection reference voltage signal for changing a level of the detection voltage signal is set to increase as the internal temperature decreases.

16. The circuit of claim 13, wherein the comparison driver includes:

a constant current source suitable for supplying a constant current to a first node and a second node;

a comparison set unit suitable for receiving the selection reference voltage signal and the division reference voltage signal to set a level of the first node and a level of the second node;

an activation unit suitable for activating the comparison set unit; and a driver suitable for driving the detection voltage signal in response to signals of the first and second nodes.

17. The circuit of claim 16, wherein the level controller includes:

a discharger suitable for discharging electric charges of the first and second nodes in response to the temperature reference voltage signal and the division reference voltage signal; and a discharge controller suitable for controlling the amount of electric charges discharged from the first and second nodes in response to the second test mode signal.

18. A semiconductor device comprising:

a control circuit suitable for generating a first test mode signal, a second test mode signal, and a power supply voltage; and an internal voltage generation circuit suitable for generating a reference voltage signal in response to the power supply voltage, suitable for generating a temperature reference voltage signal, a division reference voltage signal and a selection reference voltage signal which are obtained from the reference voltage signal, and suitable for comparing the selection reference voltage signal with the division reference voltage signal in response to the temperature reference voltage signal to generate a detection voltage signal controlling a pumping operation of an internal voltage signal, wherein a level of the temperature reference voltage signal depends on the internal temperature, wherein a level of the division reference voltage signal is constant regardless of the internal temperature, and wherein a level of the selection reference voltage signal is controlled according to a level of the internal voltage signal and a level of the first test mode signal.

19. The semiconductor device of claim 18, wherein the internal voltage generation circuit includes:

a temperature reference voltage generator suitable for including a temperature sensitive element whose resistance value varies according to the internal temperature and suitable for dividing a level of the reference voltage signal to generate the temperature reference voltage signal;

a division reference voltage generator suitable for dividing the level of the reference voltage signal to generate the division reference voltage signal; and a selection reference voltage generator suitable for dividing the level of the reference voltage signal to generate a plurality of divided voltage signals and suitable for outputting one of the divided voltage signals as the selection reference voltage signal in response to the first test mode signal.

20. The semiconductor device of claim 18, wherein the internal voltage generation circuit includes:

a comparison driver suitable for comparing the selection reference voltage signal with the division reference voltage signal to control a drive of the detection voltage signal; and a level controller suitable for comparing the temperature reference voltage signal with the division reference voltage signal in response to the second test mode signal to control a level of the selection reference voltage signal driving the detection voltage signal.

* * * * *